US008376054B2

(12) United States Patent
Lang et al.

(10) Patent No.: US 8,376,054 B2
(45) Date of Patent: Feb. 19, 2013

(54) METHODS AND SYSTEMS FOR ORIENTING IN A BORE

(75) Inventors: Loc Lang, Arlington, TX (US); David J. Steele, Arlington, TX (US); Dan P. Saurer, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 542 days.

(21) Appl. No.: 12/700,448

(22) Filed: Feb. 4, 2010

(65) Prior Publication Data

US 2011/0186291 A1 Aug. 4, 2011

(51) Int. Cl.
*E21B 23/00* (2006.01)

(52) U.S. Cl. ..... 166/381; 166/50; 166/242.6

(58) Field of Classification Search ..... 166/380, 166/381, 50, 330, 332.2, 334.1, 242.1, 242.6
See application file for complete search history.

(56) References Cited

U.S. PATENT DOCUMENTS

| | | | |
|---|---|---|---|
| 3,178,088 | A | 4/1965 | Herr |
| 3,980,106 | A | 9/1976 | Wiggins |
| 4,890,675 | A | 1/1990 | Dew |
| 5,275,240 | A | 1/1994 | Peterson et al. |
| 5,297,640 | A | 3/1994 | Jones |
| 5,458,209 | A | 10/1995 | Hayes et al. |
| 5,462,120 | A | 10/1995 | Gondouin |
| 5,564,503 | A | 10/1996 | Longbottom et al. |
| 5,579,829 | A | 12/1996 | Comeau et al. |
| 5,615,740 | A | 4/1997 | Comeau et al. |
| 5,749,605 | A | 5/1998 | Hampton et al. |
| 5,887,655 | A | 3/1999 | Haugen et al. |
| 5,944,108 | A | 8/1999 | Baugh et al. |
| 6,012,526 | A | 1/2000 | Jennings et al. |
| 6,012,527 | A | 1/2000 | Nitis et al. |
| 6,041,855 | A | 3/2000 | Nistor |
| 6,065,209 | A | 5/2000 | Gondouin |
| 6,070,665 | A | 6/2000 | Singleton et al. |
| 6,073,697 | A | 6/2000 | Parlin et al. |
| 6,202,752 | B1 | 3/2001 | Kuck et al. |
| 6,206,111 | B1 | 3/2001 | Nistor |
| 6,209,644 | B1 | 4/2001 | Brunet |
| 6,213,228 | B1 | 4/2001 | Saxman |

(Continued)

FOREIGN PATENT DOCUMENTS

| | | |
|---|---|---|
| WO | 9809053 | 3/1998 |
| WO | 2009142914 | 11/2009 |

OTHER PUBLICATIONS

Seals, Parker T. et al., "A Seal Usable in Standard O-Ring Grooves With Built-in Resistance to Spiralling and Extrusion", Parker Seal Group, Irvine, (five pages), 1992.

(Continued)

*Primary Examiner* — Daniel P Stephenson
(74) *Attorney, Agent, or Firm* — Kilpatrick, Townsend & Stockton LLP

(57) ABSTRACT

Assemblies that can be disposed in a subterranean bore are described. Certain assemblies can be used to orient a second pipe with respect to a first pipe in a bore. A second pipe can be rotationally oriented without breaking one or more control lines that may be associated or included with the second pipe by using a tool that orients the second pipe as the second pipe is moved toward a surface of the bore. In some embodiments, assemblies can be used to orient multiple portions of the second pipe with respect to multiple windows of the first pipe. The first pipe may be a casing string and the second pipe may be a tubing string.

18 Claims, 7 Drawing Sheets

U.S. PATENT DOCUMENTS

| | | | | |
|---|---|---|---|---|
| 6,374,924 | B1 | 4/2002 | Hanton et al. | |
| 6,386,287 | B2 | 5/2002 | George | |
| 6,419,021 | B1 | 7/2002 | George et al. | |
| 6,419,026 | B1 | 7/2002 | Mackenzie et al. | |
| 6,533,040 | B2 | 3/2003 | Gondouin | |
| 6,536,525 | B1 | 3/2003 | Haugen et al. | |
| 6,547,006 | B1 | 4/2003 | Kuck et al. | |
| 6,550,550 | B2 | 4/2003 | Hanton et al. | |
| 6,561,279 | B2 | 5/2003 | Mackenzie et al. | |
| 6,568,480 | B2 * | 5/2003 | Dewey | 166/382 |
| 6,766,859 | B2 | 7/2004 | Haugen et al. | |
| 6,811,189 | B1 | 11/2004 | DeLange et al. | |
| 6,848,504 | B2 | 2/2005 | Brunet et al. | |
| 6,868,909 | B2 | 3/2005 | Murray | |
| 6,913,082 | B2 | 7/2005 | McGlothen et al. | |
| 6,945,279 | B2 | 9/2005 | Baba et al. | |
| 7,025,144 | B2 | 4/2006 | Haugen et al. | |
| 7,063,143 | B2 * | 6/2006 | Tilton et al. | 166/242.6 |
| 7,104,324 | B2 | 9/2006 | Wetzel et al. | |
| 7,213,652 | B2 | 5/2007 | Hepburn et al. | |
| 7,225,875 | B2 | 6/2007 | Steele et al. | |
| 7,487,840 | B2 | 2/2009 | Gammage et al. | |
| 7,490,669 | B2 * | 2/2009 | Walker et al. | 166/313 |
| 7,588,056 | B2 | 9/2009 | Lord et al. | |
| 7,703,524 | B2 | 4/2010 | Parlin | |
| 7,726,401 | B2 | 6/2010 | Parlin et al. | |
| 2001/0035288 | A1 * | 11/2001 | Brockman et al. | 166/65.1 |
| 2002/0121375 | A1 * | 9/2002 | Ohmer et al. | 166/313 |
| 2002/0170713 | A1 | 11/2002 | Haugen et al. | |
| 2003/0024712 | A1 * | 2/2003 | Neal et al. | 166/386 |
| 2003/0075334 | A1 | 4/2003 | Haugen et al. | |
| 2003/0141063 | A1 | 7/2003 | Haugen et al. | |
| 2004/0011529 | A1 | 1/2004 | Mcgarian et al. | |
| 2004/0108116 | A1 * | 6/2004 | McLoughlin et al. | 166/321 |
| 2004/0163809 | A1 * | 8/2004 | Mayeu et al. | 166/255.1 |
| 2004/0168807 | A1 | 9/2004 | Mcglothen et al. | |
| 2004/0262006 | A1 | 12/2004 | Dewey et al. | |
| 2005/0145392 | A1 | 7/2005 | Haugen et al. | |
| 2006/0201570 | A1 | 9/2006 | Lord et al. | |
| 2006/0289156 | A1 | 12/2006 | Murray | |
| 2009/0045974 | A1 | 2/2009 | Patel | |
| 2009/0255687 | A1 | 10/2009 | Mccullough et al. | |
| 2009/0272537 | A1 | 11/2009 | Alikin et al. | |
| 2009/0288829 | A1 | 11/2009 | Parlin | |
| 2010/0051269 | A1 | 3/2010 | Smithson et al. | |
| 2010/0276158 | A1 * | 11/2010 | Ingraham | 166/381 |

OTHER PUBLICATIONS

Thiele, Jr., et al., "Comparative Machinability of Brasses, Steels and Aluminum Allows: CDA's Universal Machinability Index," SAE Technical Paper 900365, Feb. 1990 (ten pages).

Hilbert, et al., "Evaluating Pressure Integrity of Polymer Ring Seals for Threaded Connections in HP/HT Wells and Expandable Casing," 2004, IADC/SPE Drilling Conference (twelve Pages).

U.S. Appl. No. 12/726,717, filed Mar. 18, 2010 (twenty-nine pages).

U.S. Appl. No. 12/750,215, filed Mar. 30, 2010 (twenty-seven pages).

U.S. Appl. No. 12/751,343, filed Mar. 31, 2010 (thirty-two pages).

U.S. Appl. No. 12/789,822, filed May 28, 2010 (fifty-three pages).

* cited by examiner

METHODS AND SYSTEMS FOR ORIENTING IN A BORE

TECHNICAL FIELD OF THE INVENTION

The present invention relates generally to methods and systems for orienting strings, or portions of strings in a bore and, more particularly (although not necessarily exclusively), to orienting a tubing string window with respect to a casing string window in a bore.

BACKGROUND

Hydrocarbons can be produced through a wellbore traversing a subterranean formation. The wellbore can include one or more lateral wellbores extending from a parent (or main) wellbore. A lateral wellbore can be formed, for example, by diverting a milling tool in the parent wellbore through an opening that is a window of a casing string. The casing string can include multiple windows, one window for each lateral wellbore.

A tubing string can be located in the wellbore. The tubing string can include various tools or components that can be used to produce hydrocarbons from the formation, for example. The tubing string can include windows, or portions through which windows can be formed for aligning with the casing string windows. Aligning a tubing string window, or a particular tubing string portion, with a casing string window in the bore can be difficult.

Various tools have been used to position a tubing string to a selected depth and for angular orientation of the string in a bore. The tools often require the tubing string to be rotated substantially, such as more than 180°, to position the tubing string properly. Such rotation amount can be undesirable in some applications. For example, a tubing string can include one or more control lines that provide a medium for communication, power, and other services in the bore. Substantially rotating a portion of the tubing string that includes one or more control lines can cause stress on the control lines, which may result in the control lines breaking.

Therefore, systems and methods are desirable that can orient a tubing string with respect to a casing string in a bore. Systems and methods are also desirable that can perform such orientation without requiring substantial rotation in the bore of the tubing string with respect to the casing string.

SUMMARY

Certain embodiments of the present invention are directed to assemblies with which a second pipe can be oriented with respect to a first pipe in a bore. The second pipe can be rotationally oriented without breaking one or more control lines that may be associated, or included, with the second pipe by using a tool that orients the second pipe as the second pipe is moved toward a surface of the bore. In some embodiments, assemblies can be used to orient multiple portions of the second pipe with respect to multiple windows of the first pipe.

In one aspect, a system is provided that can be disposed in a bore. The system includes a first pipe, a second pipe, a tool, and a device. The first pipe includes a wall that has an opening. The first pipe defines an inner region. The second pipe can be disposed in the inner region. The tool can be coupled to the first pipe. The tool can direct the second pipe from a first position to a second position that is closer to a surface than the first position. A portion of the second pipe is adjacent to at least part of the opening when the second pipe is at the second position. The device can prevent rotation of the second pipe with respect to the first pipe after the second pipe is directed by the tool.

In at least one embodiment, the portion of the second pipe that is adjacent to at least part of the opening when the second pipe is at the second position includes a second pipe opening.

In at least one embodiment, the second pipe includes at least one control line. The second pipe is rotated no greater than 180° when it is directed from the first position to the second position.

In at least one embodiment, the wall includes a second opening. The system can include a second tool and a second device. The second tool can be coupled to the first pipe and can direct part of the second pipe from an initial position to a position closer to the surface than the initial position. The part of the second pipe can be directed independent of the portion of the second pipe that is adjacent to at least part of the opening when the second pipe is at the second position. The second device can prevent rotation by the part of the second pipe with respect to the first pipe after the part of the second pipe is directed by the tool.

In at least one embodiment, the second pipe includes a joint capable of allowing the part of the second pipe to be directed independent of the portion of the second pipe.

In at least one embodiment, the first pipe is a casing string. The second pipe is a tubing string that includes a latch key. The tool is a mule shoe. The device is a latch coupling that can receive the latch key.

In at least one embodiment, the tubing string includes a spring that can extend the latch key from an outer boundary of the tubing string.

In another aspect, a system that can be disposed in a bore is provided that includes a casing string, a tubing string, a mule shoe, and a latch coupling. The casing string defines an inner region. The tubing string can be disposed in the inner region. The tubing string includes a latch key. The mule shoe is coupled to the casing string. The mule shoe includes guides disposed between a first end and a second end. The second end can be positioned closer to a surface than the first end. At least one of the guides can direct the tubing string from the first end to the second end. The latch coupling is coupled to the casing string. The latch coupling can receive the latch key to prevent the tubing string from rotating with respect to the casing string.

In at least one embodiment, the tubing string includes latch keys in a configuration. The latch coupling includes recesses in a configuration matching the configuration of the latch keys. The recesses can receive the latch keys to prevent the tubing string from moving away from the surface.

In at least one embodiment, the tubing string is rotated no greater than 180° when it is directed from the first end to the second end.

In at least one embodiment, the casing string includes a casing string window in a wall of the casing string. The tubing string includes a tubing string window in a tubing string wall. At least part of the tubing string window is adjacent to at least part of the casing string window after the tubing string is directed to the second end.

In at least one embodiment, the casing string includes a second window in the wall of the casing string. The tubing string includes a second tubing string window. The system can include a second mule shoe and a second latch coupling. The second mule shoe is coupled to the casing string. The mule shoe can direct part of the tubing string from an initial position to a position closer to the surface than the initial position. The second latch coupling can prevent rotation of the part of the tubing string with respect to the casing string after the part of the tubing string is directed by the second mule shoe. At least part of the second tubing string window is adjacent to at least part of the second window when the part of the tubing string is at the position closer to the surface than the initial position.

In at least one embodiment, the part of the tubing string is capable of being directed by the second mule shoe independent of a portion of the tubing string positioned at the second end.

In at least one embodiment, the tubing string includes a joint capable of allowing the part of the tubing string to be directed by the second mule shoe independent of the portion of the tubing string positioned at the second end.

In at least one embodiment, the joint includes a tubing swivel and a telescoping joint. The tubing swivel can allow the part of the tubing string to be rotated independent of the portion of the tubing string positioned at the second end. The telescoping joint can allow a depth of the part of the tubing string to be changed independent of the portion of the tubing string positioned at the second end.

In another aspect, a method is provided for orienting a tubing string with respect to a casing string in a bore. The casing string is disposed in the bore. The casing string includes a casing string window associated with a lateral bore. A tool is coupled to the casing string. The tubing string is run into the bore to a first position at which the tool is closer to a surface than at least part of the tubing string. The tubing string includes a tubing string window. The tubing string is moved toward the surface to cause the tool to direct the tubing string to a second position at which at least part of the tubing string window is adjacent to at least part of the casing string window and at which a latch coupling is configured to receive a latch key of the tubing string to prevent rotation by the tubing string.

In at least one embodiment, the tool is a mule shoe that includes guides disposed between a first end and a second end. The second end is positioned closer to the surface than the first end. Moving the tubing string toward the surface includes causing the tubing string to receive the first end to direct the tubing string to a guide.

In at least one embodiment, the tubing string is run into the bore to cause the tool to be closer to the surface than the latch key.

In at least one embodiment, the casing string includes a second casing string window and the tubing string includes a second tubing string window. A second tool is caused to direct part of the tubing string from an initial position to a desired position that is closer to the surface than the initial position and to move the part of the tubing string independent of a portion of the tubing string at the second position at which at least part of the tubing string window is adjacent to at least part of the casing string window. A swivel joint is used to rotate the part of the tubing string independent of the portion of the tubing string at the second position. A telescoping joint is unlocked and used to change a depth of the part of the tubing string independent of the portion of the tubing string at the second position.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
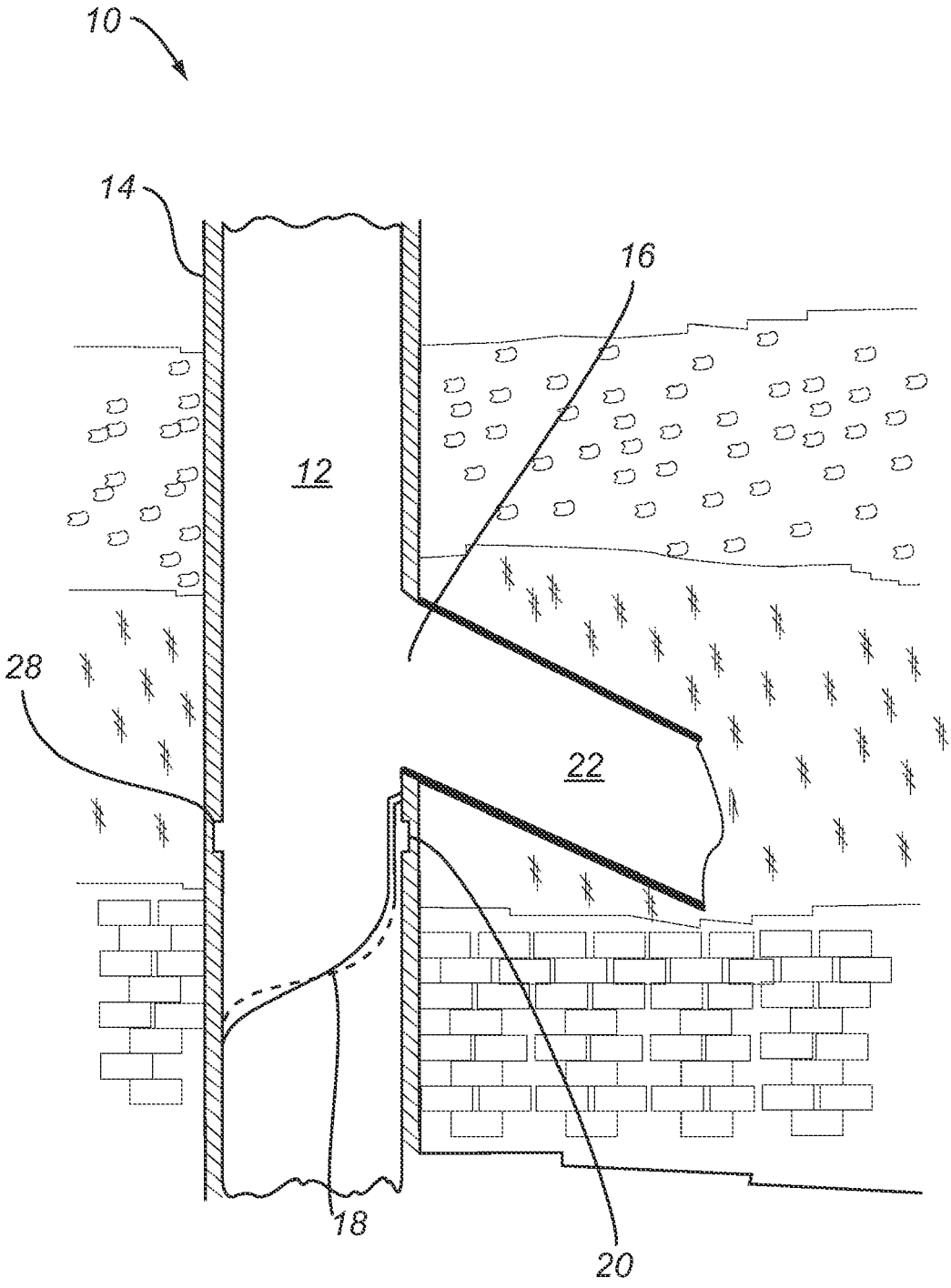
FIG. 1 is a schematic cross-sectional illustration of a well system having a parent wellbore and a lateral wellbore, along with a casing string and a tool disposed in the parent wellbore, according to one embodiment of the present invention.

Certain aspects and embodiments of the present invention relate to assemblies capable of being disposed in a bore, such as a wellbore, of a subterranean formation and with which a second pipe can be oriented with respect to a first pipe in the bore. An assembly according to certain embodiments of the present invention can allow the second pipe to be oriented with respect to the first pipe such that one or more portions of the second pipe are positioned relative to one or more windows in the first pipe. A "window" can include an opening in a wall of a pipe through which a portion of the formation adjacent to the opening can be accessed to form a lateral wellbore, for example. A lateral wellbore is a wellbore drilled outwardly from its intersection with a parent wellbore.

Certain assemblies can orient the second pipe and avoid breaking one or more control lines that may be associated or included with the second pipe. Furthermore, certain assemblies can be used to orient multiple portions of the second pipe with respect to multiple windows of the first pipe.

In some embodiments, the assembly includes a tool coupled to the first pipe that can direct the second pipe to a selected position. The assembly can also include a device that can prevent rotation by the second pipe with respect to the first pipe after the second pipe is directed by the tool. An example of a first pipe is a casing string capable of being located in a bore. An example of a second pipe is a tubing string capable of being located in the bore.

Tools according to various embodiments of the present invention can be any structures in any configurations that can direct a second pipe from a first position to a second position that is closer to a surface in the bore. An example of a tool is a "mule shoe" located with a casing string in a bore. The mule shoe can be capable of receiving a tubing string at a first end and of guiding the tubing string to a second end that is closer to the surface than the first end. The tubing string at the second end can result in a desired portion of the tubing string being adjacent to a casing string window. In some embodiments, the tubing string includes a tubing string window that is at least partially adjacent to a casing string window when the tubing string is at the second end.

Devices for preventing rotation according to various embodiments of the present invention can include any structures or configurations that can prevent a second pipe from rotating with respect to a first pipe. Devices according to some embodiments include a latch coupling, such as a latch coupling that includes a collet configured to receive and retain a latch key extending from the second pipe.

In some embodiments, the second pipe is a tubing string provided with multiple windows to be aligned with casing string windows of a casing string that is the first pipe. The tubing string can include a joint that is capable of allowing rotation by portions of the tubing string independent of other portions of the tubing string. In some embodiments, the joint can be used to align multiple tubing string windows with multiple casing string windows.

These illustrative examples are given to introduce the reader to the general subject matter discussed here and are not intended to limit the scope of the disclosed concepts. The following sections describe various additional embodiments and examples with reference to the drawings in which like numerals indicate like elements and directional descriptions are used to describe the illustrative embodiments but, like the illustrative embodiments, should not be used to limit the present invention.

FIG. 1 shows a well system 10 that includes a parent wellbore 12 according to one embodiment that extends through various earth strata. The parent wellbore 12 includes a casing string 14 cemented at a portion of the parent wellbore 12. The casing string 14 includes a window 16 that is an opening in a sidewall portion of the casing string 14. The casing string 14 also includes a tool 18 capable of directing a tubing string (not shown) to a position and includes a device 20 capable of preventing the tubing string from rotating with respect to the casing string 14 after the tubing string is at the position. The casing string 14 may be made from a suitable material such as steel.

FIG. 1 shows a lateral wellbore 22 extending from the parent wellbore 12. The lateral wellbore 22 can be formed by running a whipstock or other diverting device to a location proximate to the window 16. Cutting tools, such as mills and drills, can be lowered through the casing string 14 and deflected toward the window 16, or toward a portion of the casing string 14 at which a window is to be formed. The cutting tools mill through the window 16 and the subterranean formation adjacent to the window 16 to form the lateral wellbore 22.

Figure 2:
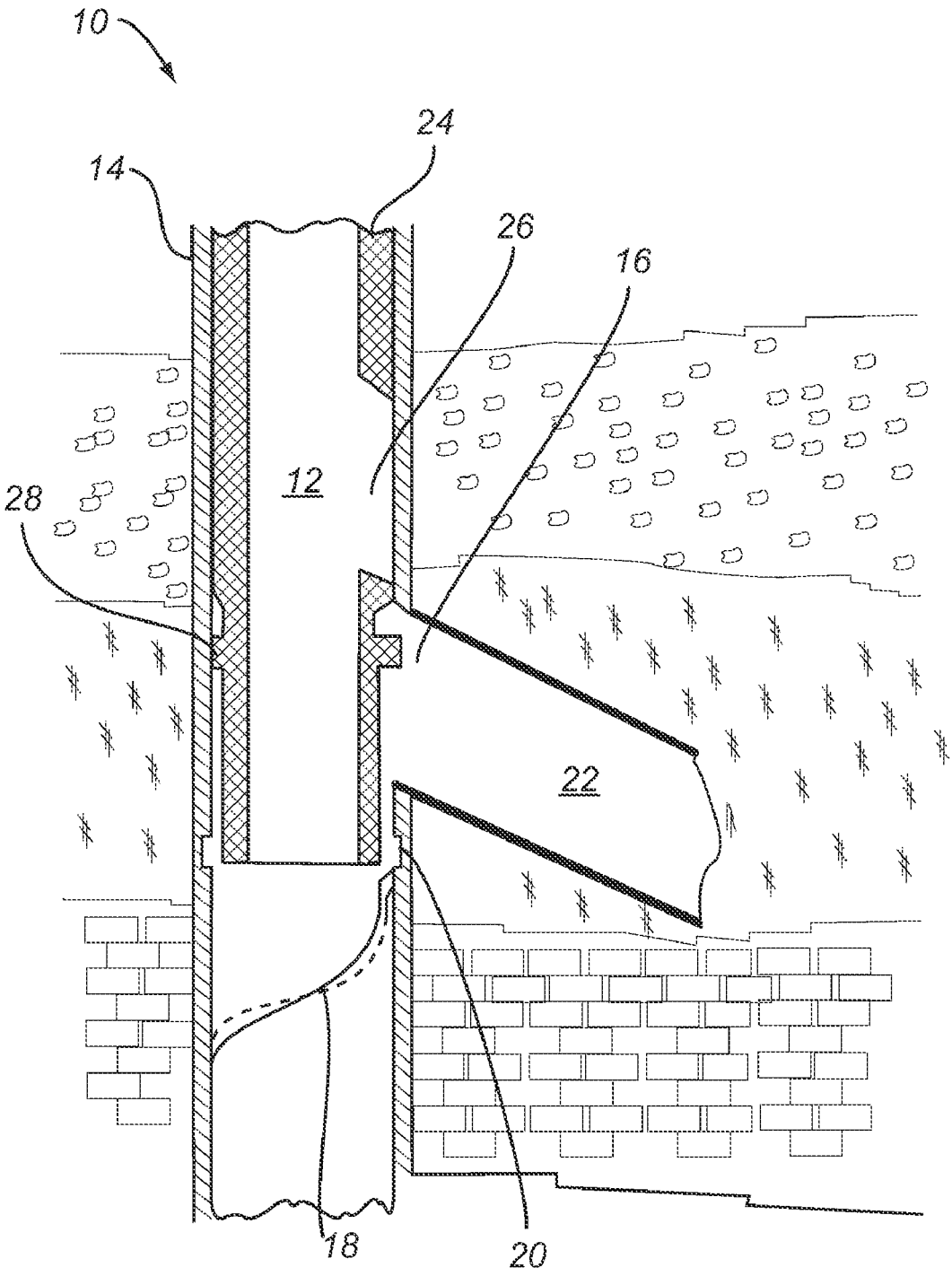
FIG. 2 is a schematic cross-sectional illustration of the well system of FIG. 1 with a tubing string disposed in the casing string according to one embodiment of the present invention.
Figure 3:
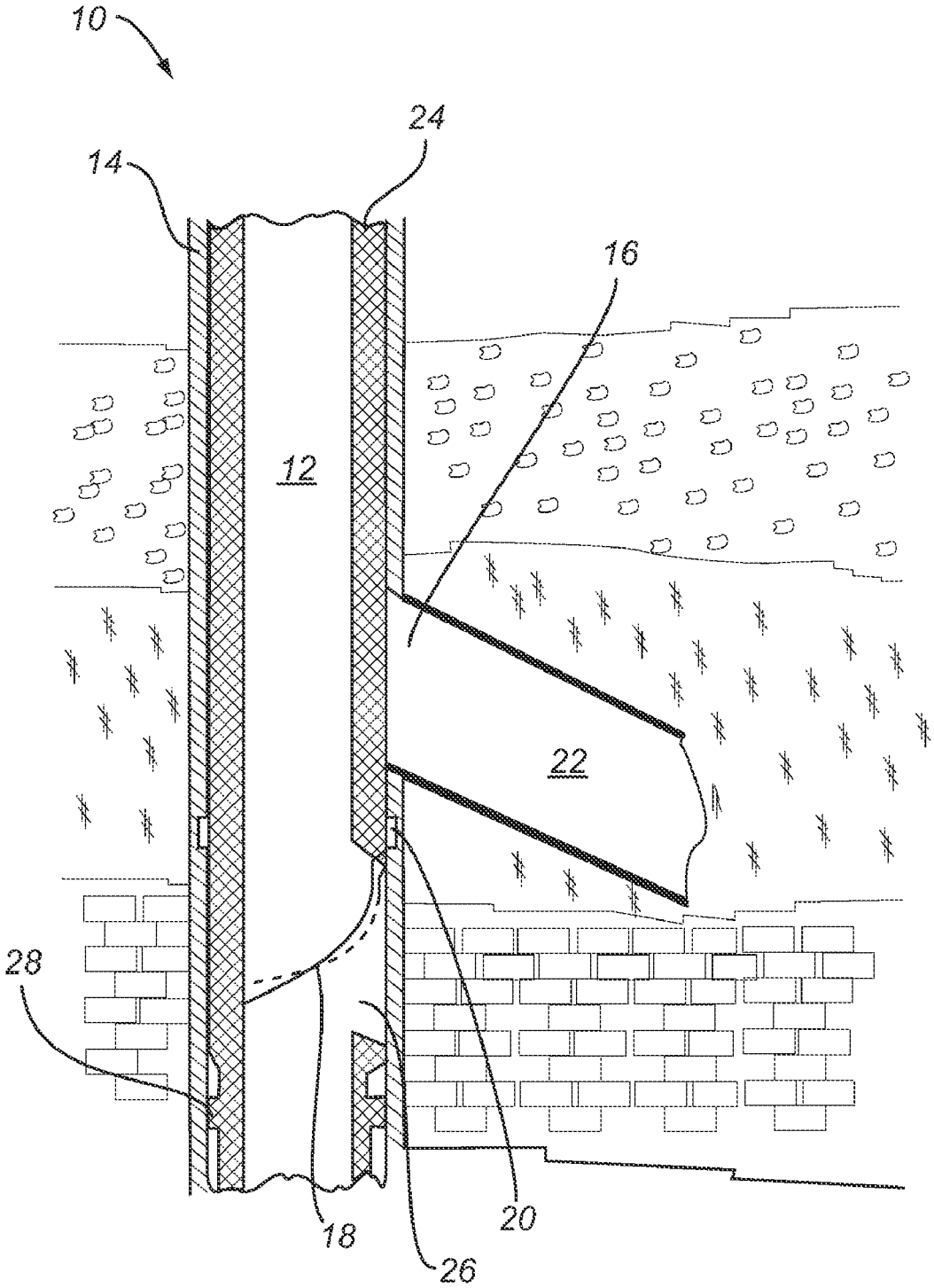
FIG. 3 is a schematic cross-sectional illustration of the well system of FIG. 2 with the tubing string positioned at an initial position according to one embodiment of the present invention.
Figure 4:
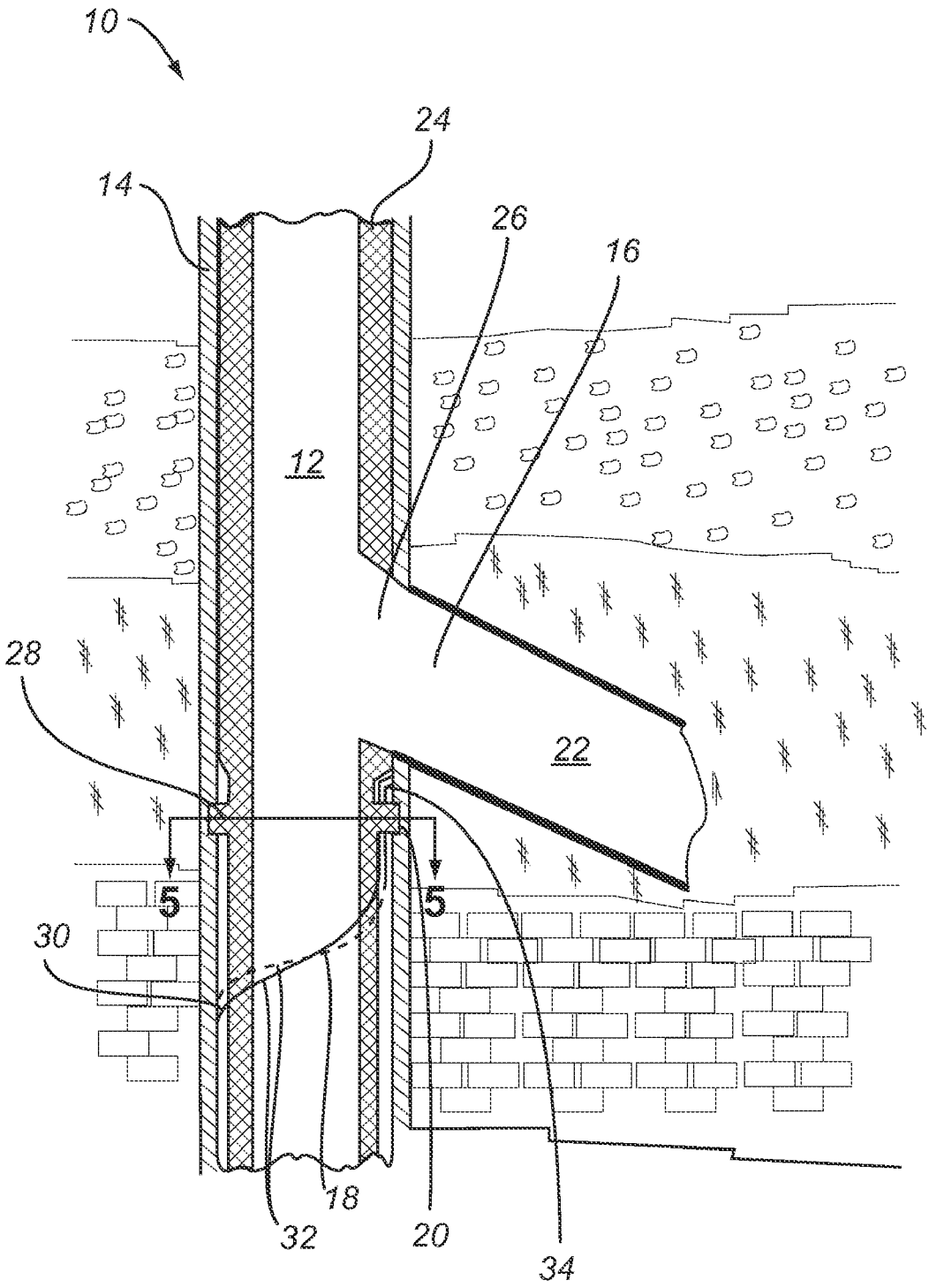
FIG. 4 is a schematic cross-sectional illustration of the well system of FIG. 3 with a tubing string oriented to a second position that is closer to the surface than the initial position according to one embodiment of the present invention.

A tubing string can be run in the inner region of the casing string 14 to assist in hydrocarbon production or otherwise. Certain embodiments of the present invention can be used to orient the tubing string with respect to the casing string 14 to allow, for example, the lateral wellbore 22 to be accessed via the tubing string. FIGS. 2-4 depict a tubing string 24 being oriented with respect to the casing string 14 via an assembly according to one embodiment of the present invention. Although FIGS. 2-5 depict a tubing string being oriented with respect to a casing string, embodiments of the present invention can be used to orient any type of pipe (or tool or device) with respect to another.

FIG. 2 depicts the tubing string 24 being run in an inner region of the casing string 14. The tubing string 24 can be run via any technique or method. The tubing string 24 includes a tubing string window 26 that is an opening in a sidewall of the tubing string 24. The tubing string 24 also includes a latch key 28 extending from an outer portion of the tubing string 24. In some embodiments, the latch key 28 is a spring-loaded member that is capable of extending from an outer boundary of the tubing string 24. Certain embodiments of the present invention can be used to position the tubing string window 26 with respect to the casing string 14 in the parent wellbore 12.

The tubing string 24 can be run to an initial position, as shown in FIG. 3. At the initial position, the tubing string window 26 is past the window 16 of the casing string 14 such that the window 16 is closer to the surface than the tubing string window 26. Furthermore, the tool 18 is closer to the surface than at least part of the tubing string 24 when the tubing string 24 is at the initial position.

The tubing string 24 can be moved toward the surface to be oriented such that at least part of the tubing string window 26 is adjacent to at least part of the window 16, as depicted in FIG. 4. Moving the tubing string 24 toward the surface can cause the tool 18 to direct the tubing string 24 to a second position at which part of the tubing string window 26 is adjacent to the window 16. At the second position, the device 20 can prevent the tubing string 24 from rotating with respect to the casing string 14. For example, the device 20 may be a latch coupling that can receive the latch key 28 extending from the tubing string 24. In some embodiments, the latch coupling also prevents the tubing string 24 from changing depth in one or more directions, such as downward. An example of a latch coupling the latch coupling is a J-slot. Assemblies according to some embodiments can include a depth reference coupling that can be used to find depth downhole.

Latch couplings according to various embodiments of the present invention can be any device or configuration that can prevent rotation of the tubing string 24 with respect to the casing string 14 when the tubing string is at the second position. In some embodiments, the latch coupling is a keyless latch, such as those described in U.S. Pat. No. 5,579,829 to Comeau.

For example, the latch coupling can include receiving recesses formed on the inner surface of a casing string. The receiving recesses can be spaced circumferentially around the inner surface of the casing string and include varying profiles. The receiving recesses can be configured to mate with spring-loaded latches having profiles corresponding to those of the receiving recesses. The spring loading forces the latches to move out radially and to mate in the recesses when the latches are properly aligned axially and circumferentially with appropriate recesses. These latch couplings can be used to, for example, avoid clearance restricting projections extending inwardly from a string wall and allow weight (e.g. 30,000 lbs or more) to be set on a landed system. These latch couplings used in conjunction with the mule shoe can also allow a tubing string to be run past a proper depth, moved to the proper depth and orientation in accordance with the profile, and then prevented the tubing string from being moved past the proper depth. Furthermore, these latch couplings can provide surface operators with confirmation that the tubing string is aligned at the proper depth and orientation. For example, the latch couplings can prevent downward movement by the tubing string if properly aligned, but allow downward movement if not properly aligned.

In some embodiments, assemblies include this type of latch coupling as a second latch coupling in addition to the latch coupling for positioning a tubing string with respect to a casing string. For example, this type of latch coupling can be using to position whipstocks or other components.

Tools according to various embodiments of the present invention can be in any configuration that can direct a pipe to a second position from a first position without requiring the pipe to rotate substantially, such as more than 180°. In other embodiments, tools can be provided that allow for 360° rotation in orienting one pipe with respect to another. In the embodiments shown in FIGS. 1-4, the tool 18 is a mule shoe assembly that has a pointed first end 30 to complement part of the tubing string 24. For example, the tubing string 24 can include one or more keys that may be spring loaded that cooperate with the first end 30 when the tubing string 24 is moved toward the surface.

The first end 30 can direct the tubing string 24 to guides 32 as the tubing string 24 is moved toward the surface. The guides 32 may be a pair of curved, generally helical edges extending from the first end 30 to a second end 34 that is closer to the surface than the first end 30. The guides 32 can direct the tubing string 24 to a proper axial and rotational position relative to a longitudinal axis defined by the parent wellbore 12. In some embodiments, the second end 34 intersects a latch coupling for receiving the latch key 28. When the latch coupling receives the latch key 28, it can prevent rotation by the tubing string 24 with respect to the casing string 14. At least part of the tubing string window 26 can be aligned with at least part of the window 16 when the tubing string 24 is directed to the proper position.

Using a mule shoe can limit the amount of rotation needed by the tubing string 24, such as to no more than 180°. For example, the tubing string 24 can be directed by one of the two guides 32 such that rotation of the tubing string 24 to reach the second position is prevented from exceeding 180°.

Figure 5:
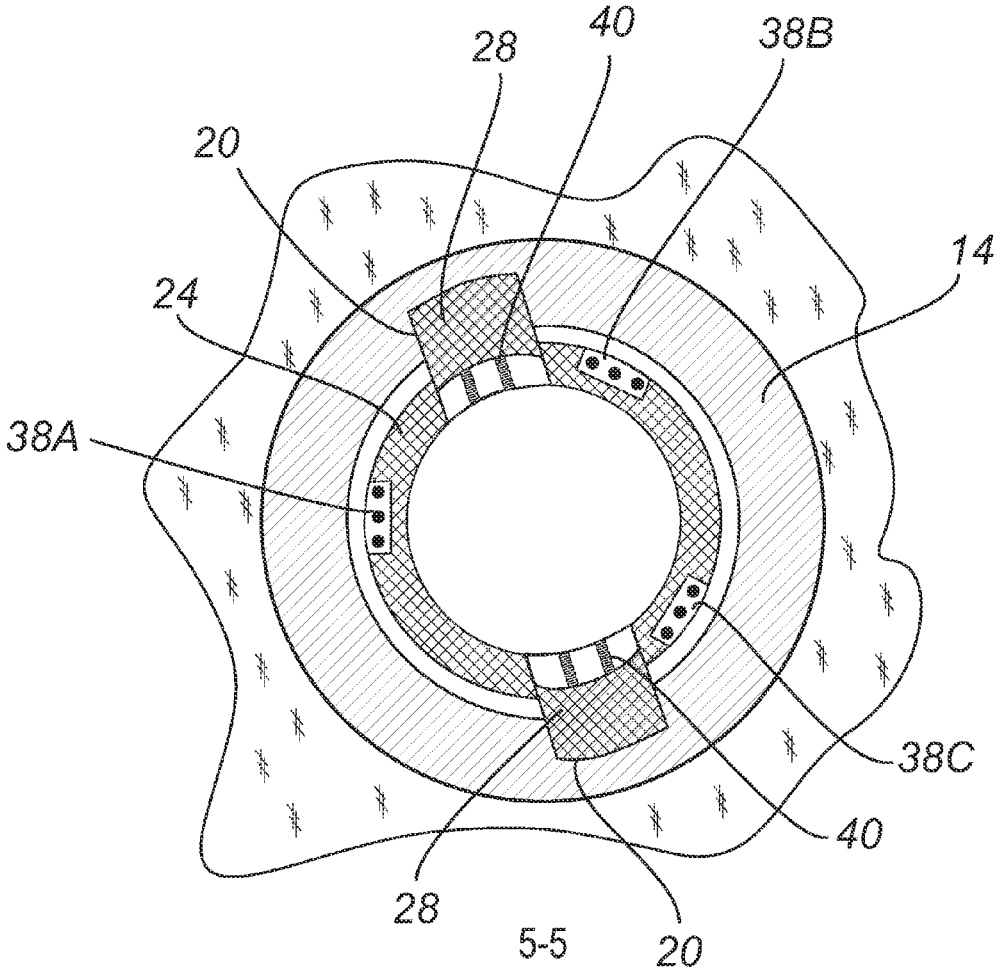
FIG. 5 is a cross-sectional view of the assembly of FIG. 4 along line 5-5 according to one embodiment of the present invention.

The latch key 28 may be a spring-loaded latch key configured to be received by the latch coupling when the tubing string 24 is at the proper position. FIG. 5 depicts a cross-sectional view of an embodiment of the latch coupling receiving the latch key 28, along line 5-5 from FIG. 4. The casing string 14 includes a device that is a latch coupling 20 that is shaped to receive the latch key 28 extending from an outer boundary of the tubing string 24. The tubing string 24 can be located in an inner region of the casing string 14.

The tubing string 24 can include one or more control lines, such as control lines 38A-C. The control lines 38A-C may include a medium through which power can be provided to one or more tools or other devices positioned in the bore or through which data and control signals can be communicated between such tools or devices and instruments located at or near the surface. The tubing string 24 can also include springs 40 disposed between the latch and an inner wall of the tubing string 24. The springs 40 can cause the latch key 28 to extend outwardly from an outer boundary of the tubing string 24. Although springs 40 are depicted in FIG. 5, any suitable device can be used. An example of such a device is a collet. The latch key 28 can be received by the latch coupling 20 and can cooperate with the latch coupling 20 to prevent the tubing string 24 from rotating with respect to the casing string 14. Although FIG. 5 depicts two latch keys 28, any number from one to many, latch keys can be used with various embodiments of the present invention. In some embodiments, three or four latch keys 28 are used.

Certain embodiments of the present invention can avoid breaking one or more of the control lines 38A-C while positioning the tubing string 24 in the parent wellbore 12 by preventing the tubing string 24 from rotating substantially. For example, the tubing string 24 can be prevented from rotating more than 180° in moving the tubing string 24 to the desired position and can be prevented from rotating after it is in the desired position.

Certain embodiments of the present invention can be implemented in multilateral wellbores to allow positioning of a tubing string with respect to a casing string to align multiple tubing string windows with multiple casing string windows. A multilateral wellbore can include a parent (or main) wellbore with more than one lateral wellbore extending from it. A casing string can be positioned in the parent wellbore. The casing string can include windows (or windows can be formed in the casing) through which the lateral wellbores can be formed and accessed.

A tubing string can be positioned in an inner region of the casing string. The tubing string can include tubing string windows (or portions of a side wall through which windows are to be formed). Each tubing string window is to be aligned generally with a window of the casing string. Certain embodiments of the present invention can be used to align the tubing string windows generally with the windows in the casing string and to avoid requiring the tubing string to be rotated substantially.

Figure 6:
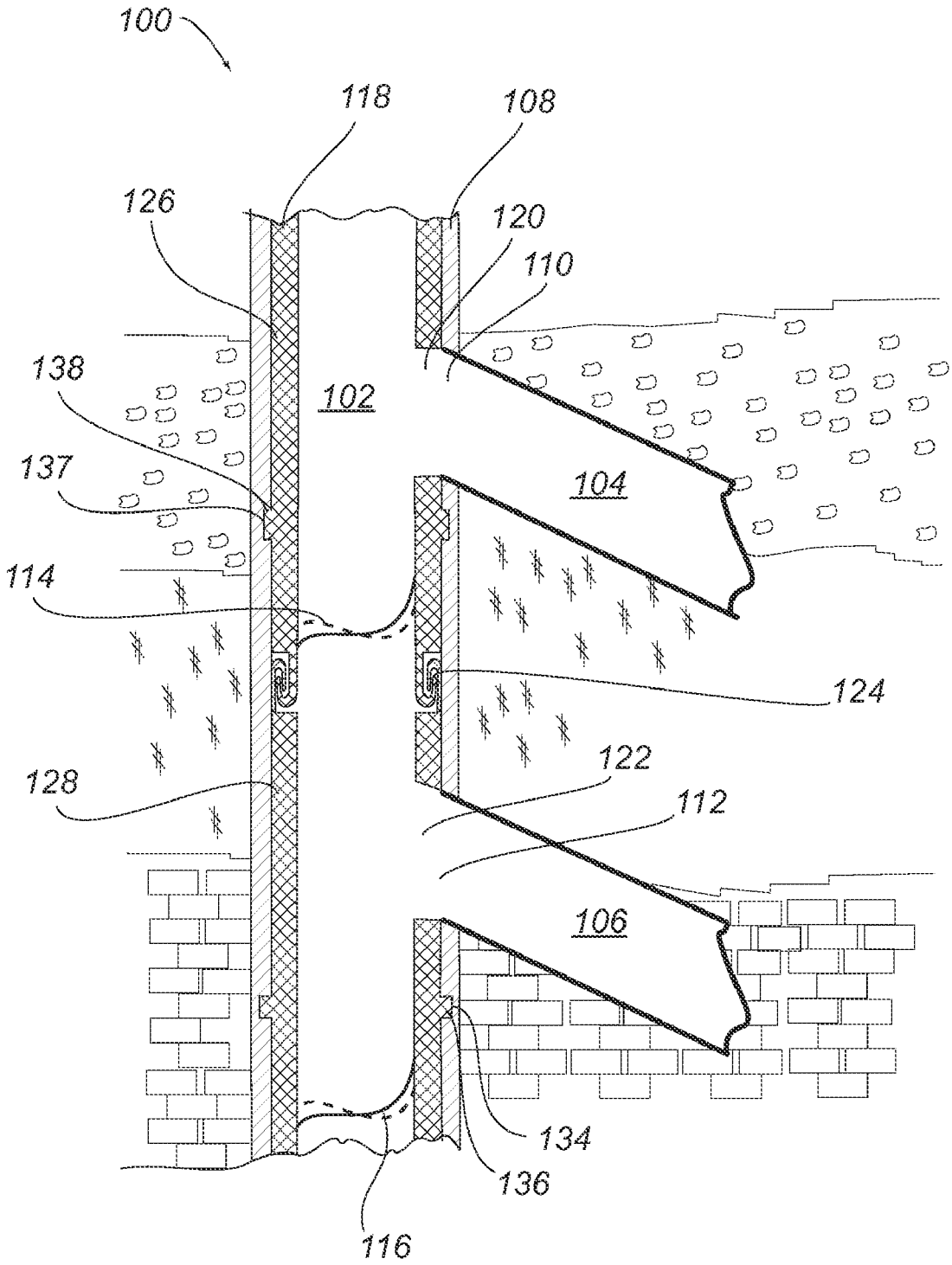
FIG. 6 is a cross-sectional view of a well system that includes a multilateral wellbore in which a tubing string is oriented in a parent wellbore with respect to a casing string according to one embodiment of the present invention.

FIG. 6 depicts an embodiment of a multilateral wellbore system 100 that includes a parent wellbore 102 and two lateral wellbores 104, 106 extending from the parent wellbore 102. A casing string 108 is disposed in the parent wellbore 102. The casing string 108 includes a window 110 associated with lateral wellbore 104 and a second window 112 associated with lateral wellbore 106. The lateral wellbores 104, 106 can be accessed through the windows 110, 112. The casing string 108 also includes devices 114, 116 for orienting parts or sections of a tubing string 118 with respect to the casing string 108 in the parent wellbore 102. Each of the devices 114, 116 may be a mule shoe.

The tubing string 118 can include a tubing string window 120 aligned generally with the window 110 and a second tubing string window 122 aligned generally with the second window 112. In other embodiments, the tubing string 118 includes portions generally aligned with the windows 110, 112 and through which tubing string windows can be made.

The tubing string 118 can be positioned using various techniques, including the techniques described with reference to FIGS. 2-5 for generally aligning one tubing string window with one casing string window. In some embodiments, the tubing string 118 can be positioned in sections using a component such as a joint 124.

For example, the tubing string 118 can include a first section 126 associated with the tubing string window 120 and a second section 128 associated with the second tubing string window 122. The second section 128, coupled to the first section 126 by the joint 124, can be positioned to a desired position by using techniques similar to those described with reference to FIGS. 2-4. A latch coupling 134 associated with the casing string can receive a latch key 136 associated with the second section 128 to prevent the second section 128 from rotating with respect to the casing string 108.

Figure 7:
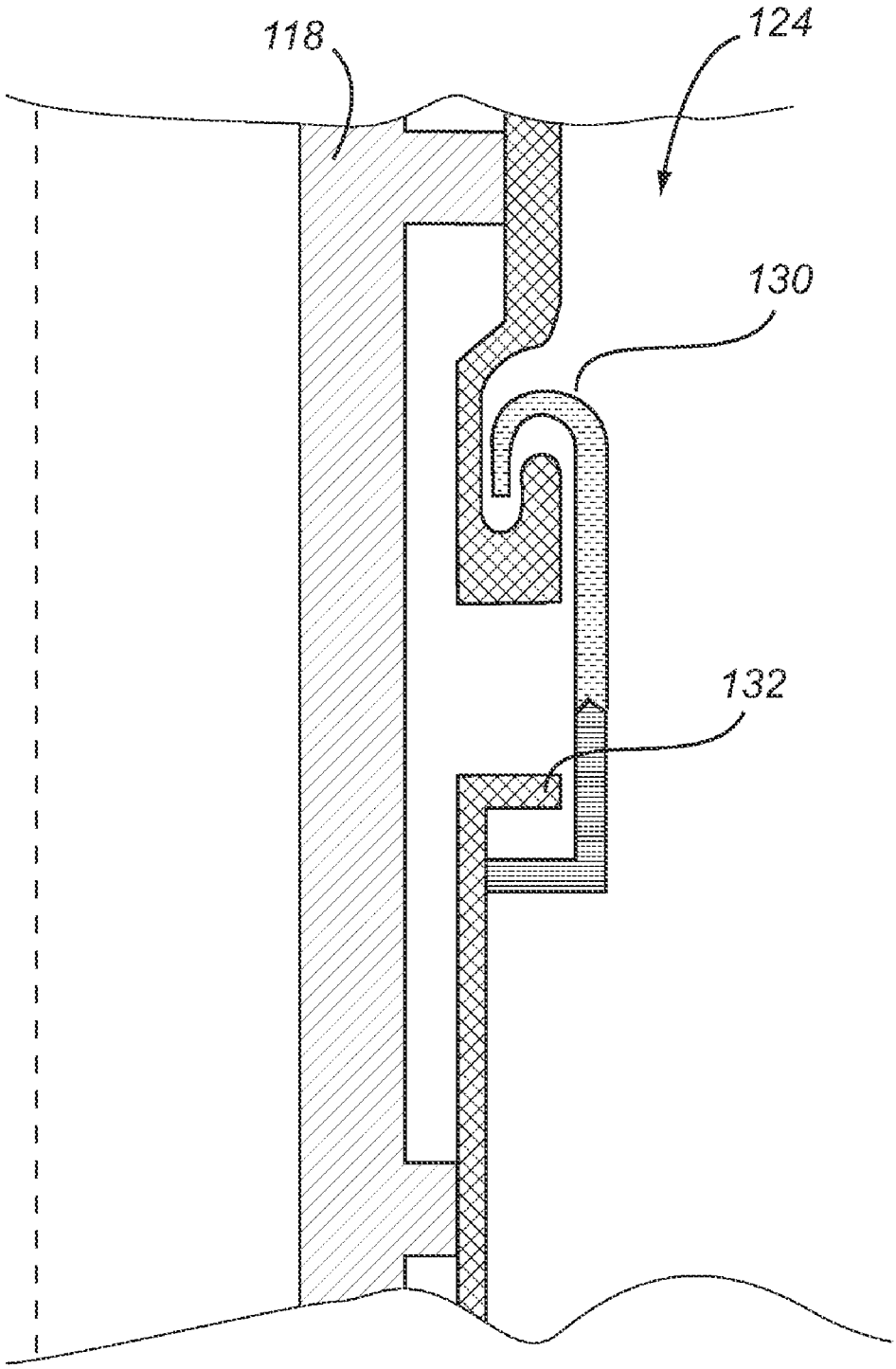
FIG. 7 is a partial cross-sectional view of a joint in FIG. 6 according to one embodiment of the present invention.

After the second section 128 is positioned, the first section 126 can be moved independent of the second section 128 at the joint 124. The first section 126 can be moved independent of the second section 128 using any technique. The technique may depend in part on the configuration of the joint 124, which may include any devices and may be any shape that allows the first section 126 to be moved independent of the second section 128. FIG. 7 depicts a cross-sectional view of part the casing string 108 and the tubing string 118 at the joint 124 according to one embodiment. The joint 124 includes a tubing swivel 130 and a telescoping joint 132 in the tubing string 118. The tubing swivel 130 allows the first section 126 to be rotated independent of the second section 128. In some embodiments, the tubing swivel 130 can be selectively locked to prevent rotation and/or can include rotational limitations to prevent the amount of rotation allowed by the tubing swivel 130. The telescoping joint 132 allows the depth of first section 126 to change (both increase and decrease) independent of the depth of the second section 128. In some embodiments, the telescoping joint 132 is locked into a position until it is selectively unlocked to allow telescoping to provide an increase or decrease in depth by the first section 126. The first section 126 can be positioned using any technique, such as the techniques described with reference to FIGS. 2-4. When the first section 126 is positioned, a second latch coupling 137 of the casing string 108 can receive a first section latch key 138 to prevent the first section 126 from rotating with respect to the casing string 108.

Latch couplings according to certain embodiments of the present invention can be configured to include a selective latch coupling profile that corresponds to a specific latch key profile on a tubing string, but does not correspond to a second latch key profile on the tubing string. When the tubing string is at the second position, the selective latch coupling profile can receive the specific latch key profile and prevent the tubing string from rotating. Using a selective latch coupling, each portion of a tubing string can be selective to a specific latch coupling profile.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A system capable of being disposed in a bore, the system comprising:

a first pipe comprising a wall having an opening, the first pipe defining an inner region;

a second pipe capable of being disposed in the inner region;

a tool coupled to the first pipe, the tool being capable of guiding the second pipe from a first position to a second position that is closer to a surface than the first position, wherein a portion of the second pipe is adapted to be adjacent to at least part of the opening when the second pipe is at the second position, the portion of the second pipe comprising a second pipe opening; and a device capable of preventing rotation of the second pipe with respect to the first pipe after the second pipe is directed by the tool.

2. The system of claim 1, wherein the second pipe comprises at least one control line, wherein the second pipe is adapted to be rotated no greater than 180° when it is directed from the first position to the second position.

3. The system of claim 1, wherein the wall comprises a second opening, the system further comprising:

a second tool coupled to the first pipe, the second tool being capable of guiding part of the second pipe from an initial position to a position closer to the surface than the initial position, wherein the part of the second pipe is capable of being directed independent of the portion of the second pipe that is adjacent to at least part of the opening when the second pipe is at the second position; and a second device capable of preventing rotation by the part of the second pipe with respect to the first pipe after the part of the second pipe is directed by the tool.

4. The system of claim 3, wherein the second pipe comprises a joint capable of allowing the part of the second pipe to be directed independent of the portion of the second pipe that is adjacent to at least part of the opening when the second pipe is at the second position.

5. The system of claim 1, wherein:

the first pipe is a casing string;

the second pipe is a tubing string comprising a latch key;

the tool is a mule shoe; and the device is a latch coupling capable of receiving the latch key.

6. The system of claim 5, wherein the tubing string comprises a spring capable of extending the latch key from an outer boundary of the tubing string.

7. A system capable of being disposed in a bore, the system comprising:

a casing string, the casing string defining an inner region;

a tubing string capable of being disposed in the inner region, the tubing string comprising a latch key and at least one control line;

a mule shoe coupled to the casing string, the mule shoe comprising guides disposed between a first end and a second end, the second end being capable of being positioned closer to a surface than the first end, wherein at least one of the guides is capable of guiding the tubing string from the first end to the second end, wherein the tubing string is adapted to be rotated no greater than 180° when it is guided from the first end to the second end; and a latch coupling coupled to the casing string, the latch coupling being capable of receiving the latch key to prevent the tubing string from rotating with respect to the casing string.

8. The system of claim 7, wherein the latch coupling is capable of receiving the latch key after the tubing string is directed by at least one of the guides.

9. The system of claim 7, wherein the tubing string comprises a plurality of latch keys in a configuration, wherein the latch coupling comprises a plurality of recesses in a configuration matching the configuration of the plurality of latch keys to receive the plurality of latch keys and to prevent the tubing string from moving away from the surface.

10. The system of claim 7, wherein the casing string comprises a casing string window in a wall of the casing string, wherein the tubing string comprises a tubing string window in a tubing string wall, wherein at least part of the tubing string window is adjacent to at least part of the casing string window after the tubing string is directed to the second end.

11. The system of claim 10, wherein the casing string comprises a second window in the wall of the casing string, wherein the tubing string comprises a second tubing string window, the system further comprising:

a second mule shoe coupled to the casing string, the second mule shoe being capable of guiding part of the tubing string from an initial position to a position closer to the surface than the initial position; and a second latch coupling capable of preventing rotation of the part of the tubing string with respect to the casing string after the part of the tubing string is directed by the second mule shoe, wherein at least part of the second tubing string window is adjacent to at least part of the second window when the part of the tubing string is at the position closer to the surface than the initial position.

12. The system of claim 11, wherein the part of the tubing string is capable of being directed by the second mule shoe independent of a portion of the tubing string positioned at the second end.

13. The system of claim 12, wherein the tubing string comprises a joint capable of allowing the part of the tubing string to be directed by the second mule shoe independent of the portion of the tubing string positioned at the second end.

14. The system of claim 13, wherein the joint comprises:

a tubing swivel capable of allowing the part of the tubing string to be rotated independent of the portion of the tubing string positioned at the second end; and a telescoping joint capable of allowing a depth of the part of the tubing string to be changed independent of the portion of the tubing string positioned at the second end.

15. A method for orienting a tubing string with respect to a casing string in a bore, the method comprising:

disposing the casing string in the bore, the casing string comprising a casing string window associated with a lateral bore, wherein a tool is coupled to the casing string;

moving the tubing string into the bore to a first position at which the tool is closer to a surface than at least part of the tubing string, the tubing string comprising a tubing string window; and moving the tubing string toward the surface to cause the tool to direct the tubing string to a second position at which at least part of the tubing string window is adjacent to at least part of the casing string window and at which a latch coupling is configured to receive a latch key of the tubing string to prevent rotation by the tubing string.

16. The method of claim 15, wherein the tool is a mule shoe comprising guides disposed between a first end and a second end, the second end being positioned closer to the surface than the first end, wherein moving the tubing string toward the surface to cause the tool to direct the tubing string to a position at which at least part of the tubing string window is adjacent to at least part of the casing string window comprises:

moving the tubing string toward the surface to cause the tubing string to receive the first end to direct the tubing string to a guide.

17. The method of claim 15, wherein moving the tubing string into the bore to the first position at which the tool is closer to the surface than at least part of the tubing string comprises:

moving the tubing string into the bore to cause the tool to be closer to the surface than the latch key.

18. The method of claim 15, wherein the casing string comprises a second casing string window, wherein the tubing string comprises a second tubing string window, the method further comprising:

causing a second tool to direct part of the tubing string from an initial position to a desired position that is closer to the surface than the initial position to move the part of the tubing string independent of a portion of the tubing string at the second position at which at least part of the tubing string window is adjacent to at least part of the casing string window, comprising:

using the swivel joint to rotate the part of the tubing string independent of the portion of the tubing string at the second position at which at least part of the tubing string window is adjacent to at least part of the casing string window;

unlocking a telescoping joint; and using the telescoping joint to change a depth of the part of the tubing string independent of the portion of the tubing string at the second position at which at least part of the tubing string window is adjacent to at least part of the casing string window.

* * * * *